US008163255B1

(12) United States Patent
Rudolph

(10) Patent No.: US 8,163,255 B1
(45) Date of Patent: Apr. 24, 2012

(54) DEVICE FOR OPENING MEDICINAL AMPULE

(76) Inventor: Darrel L. Rudolph, Fort Wayne, IN (US)

( * ) Notice: Subject to any disclaimer, the term of this patent is extended or adjusted under 35 U.S.C. 154(b) by 2231 days.

(21) Appl. No.: 10/914,071

(22) Filed: Aug. 9, 2004

(51) Int. Cl.
*B01L 9/00* (2006.01)

(52) U.S. Cl. ..... 422/521; 141/98; 211/74; 225/103

(58) Field of Classification Search ..... 422/521; 225/103; 211/74; 141/98
See application file for complete search history.

(56) References Cited

U.S. PATENT DOCUMENTS 2,672,980 A * 3/1954 Halbach ..... 206/528
3,777,949 A 12/1973 Chiquiari-Arias
4,453,639 A * 6/1984 Sharma ..... 211/74
4,784,506 A 11/1988 Koreska et al.
5,052,588 A 10/1991 Schlosser
5,098,297 A 3/1992 Chari et al.
5,393,497 A 2/1995 Haber et al.
5,601,128 A * 2/1997 Furphy ..... 141/98
5,695,465 A 12/1997 Zhu
6,039,488 A 3/2000 Krawczyk et al.
6,270,473 B1 8/2001 Schwebel
2004/0182904 A1* 9/2004 Starr ..... 225/11

* cited by examiner

*Primary Examiner* — Jill Warden
(74) *Attorney, Agent, or Firm* — John D. Gugliottam, Esq.

(57) ABSTRACT

A device for opening medicinal ampules is an apparatus to protect oneself from injury and prevent possible waste when utilizing injection medication dispensed in ampules. The device has a box type assembly with approximate dimensions of four inches wide, two inches deep and two inches high. The interior of the box is capable of holding up to three ampules at one time. The ampules are simply placed in their holding holes, and the lid is lowered. A sharp smack, administered by the user's hand and cushioned by foam padding, is adequate to snap off the neck of the ampules. The invention then serves as a holder for the ampule body while removing the medication with a syringe and for safe disposal thereafter.

8 Claims, 4 Drawing Sheets

DEVICE FOR OPENING MEDICINAL AMPULE

RELATED APPLICATIONS

The present invention was first described in Disclosure Document Registration 544,267 filed on Dec. 29, 2003 under 35 U.S.C. §122, 37 C.F.R. §1.14 and MPEP §1706. There are no previously filed, nor currently any co-pending applications, anywhere in the world.

BACKGROUND OF THE INVENTION

1. Field of the Invention

The present invention relates generally to a medical ampule opening device and, more particularly, to a device for inserting an ampule therein and severing the top portion thereof.

2. Description of the Related Art

Ampules are sealed glass vials that hold various types of liquid or powered medicine. They are opened by simply snapping the thin neck of the vial off, thus allowing the liquid and allowing it to be drawn off with a syringe or the powder to be mixed with a water solution as dispensed and then withdrawn via a syringe. While ampules do their job exceedingly well, they often cause nasty cuts to the fingers and hands of their users when the glass neck is snapped off. Additionally, many users, whether they be professional medical workers such as doctors or nurses, or patients who self administer medicine, find it difficult to snap off the ampule neck due to lack of leverage. This lack of leverage, coupled with the haste to get the job done, often causes some of the worst cuts as aforementioned described. Additionally, the user risks dropping the ampule during the process, and the associated loss of medicine should it break. Accordingly, there exists a need for a means by which ampules can be opened quickly and easily, without exposing the user to potential cuts from broken glass. The development of the present invention fulfills this need.

A search of the prior art did not disclose any patents that read directly on the claims of the instant invention; however, the following references were considered related:

U.S. Pat. No. 3,777,949, issued in the name of Chiquiari-Arias, discloses an improved single dose disposable container and accessories;

U.S. Pat. No. 4,784,506, issued in the name of Koreska et al., discloses a breakable ampule with swab;

U.S. Pat. No. 5,052,588, issued in the name of Schlosser, discloses ampule having a fracturing outlet end, a piston and a breakable end;

U.S. Pat. No. 5,098,297, issued in the name of Chari et al., discloses an apparatus for application of a tooth desensitizing composition having a flexible body, a crushable ampule, and desensitizing material;

U.S. Pat. No. 5,393,497, issued in the name of Haber et al., discloses a device for containing and opening a glass ampule and transferring the liquid contained in the ampule;

U.S. Pat. No. 5,695,465, issued in the name of Zhu, discloses a syringe having a drug to be injected;

U.S. Pat. No. 6,039,488, issued in the name of Krawczyk et al., discloses a breakable ampule swab and cap for scented material; and U.S. Pat. No. 6,270,473, issued in the name of Schwebel, discloses a hypodermic jet injector and disposable ampule.

Consequently, there exists a continuous need for new ideas and enhancements for existing products in the ampule opening industry.

SUMMARY OF THE INVENTION

It is therefore an object of the present invention to provide a device for opening a medicinal ampule.

It is a feature of the present invention to provide an improved device for opening a medicinal ampule having a container and a lid, the container retaining the ampule and the lid used as a conduit for delivering a force so as to sever the top of the ampule from the body of the ampule.

It is another feature of the present invention to provide a device having a plurality of recesses for severing a plurality of ampules simultaneously.

It is yet another feature of the present invention to provide a device having a plurality of cushions for absorbing excess force and for stabilizing the lid when in contact with the ampules.

It is yet another feature of the present invention to provide a device having indicia corresponding to each respective recess.

Briefly described according to one embodiment of the present invention, a device for opening medicinal ampules is an apparatus to protect oneself from injury and prevent possible waste when utilizing injection medication dispensed in ampules. The device has a box type assembly with approximate dimensions of four inches wide, two inches deep and two inches high. The interior of the box is capable of holding up to three ampules at one time. The ampules are simply placed in their holding holes, and the lid is lowered. A sharp smack, administered by the user's hand and cushioned by foam padding, is adequate to snap off the neck of the ampules. The invention then serves as a holder for the ampule body while removing the medication with a syringe. When completed, the empty ampules are simply disposed of, with no need to touch them and no need to risk cuts or scrapes. The invention will fit almost any size ampule, and can be used over and over again on other ampules. The use of the device for opening medicinal ampules allows for the opening of medicine ampules in a manner, which is not only quick, easy and effective, but most importantly can be done safely with one hand.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
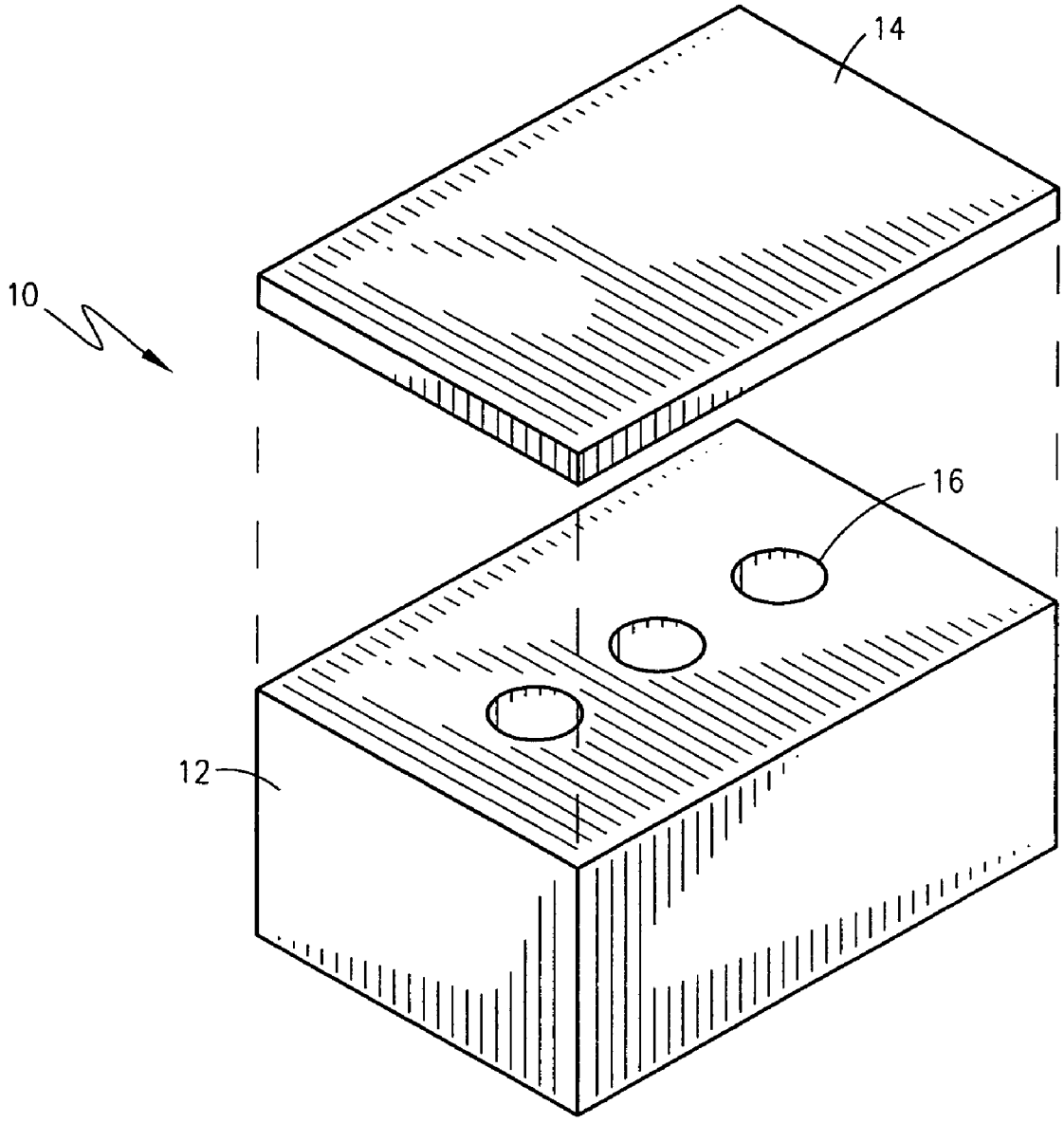
FIG. 1 is an exploded perspective view of a device for opening medicinal ampules having a container and a lid.

The best mode for carrying out the invention is presented in terms of its preferred embodiment, herein depicted within FIGS. 1 through 7.

1. Detailed Description of the Figures

Referring to FIG. 1 through FIG. 7, a device for opening medicinal ampules 10, is shown in accordance to a preferred embodiment of the present invention. The device 10 comprises a container 12 and a lid (or top) 14, the container 12 retaining at least one ampule "$A_1$" and the lid 14 selectively placed so as to sever the top from the ampule. Once the top is severed, the medicament contained within the ampule may be extracted for administration to a patient.

The container 12 comprises a structure configured for accommodation of a medicinal ampule in an upright and vertical orientation. As such, the container 12 has a depth dimensioned so that the top of the ampule is exposed so that severing of the top may be achieved. The depth will measure approximately two inches to accommodate typical or standard medicinal ampules. The container 12 may have a variety of geometric configurations, including a disc shape, an orthogonal shape, or another polygonal shape.

In the disclosed embodiments of FIG. 1 through FIG. 6, the container 12 has at least one recess 16 for retaining a medicinal ampule. It is envisioned that a plurality of recesses 16 may be provided (as depicted in FIGS. 1 through 6. Each recess 16 will correspond to the depth of the container 12 so that the recess 16 retains a medicinal ampule in an upright and vertical orientation so that severing of the top may be achieved. Thus, each recess 16 will measure approximately two inches in depth.

Figure 2:
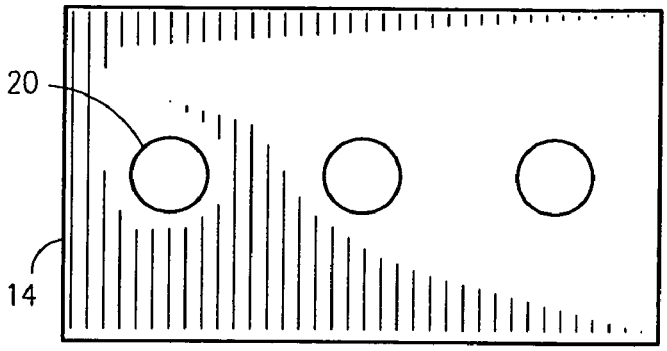
FIG. 2 is a bottom view of the lid of FIG. 1.
Figure 3:
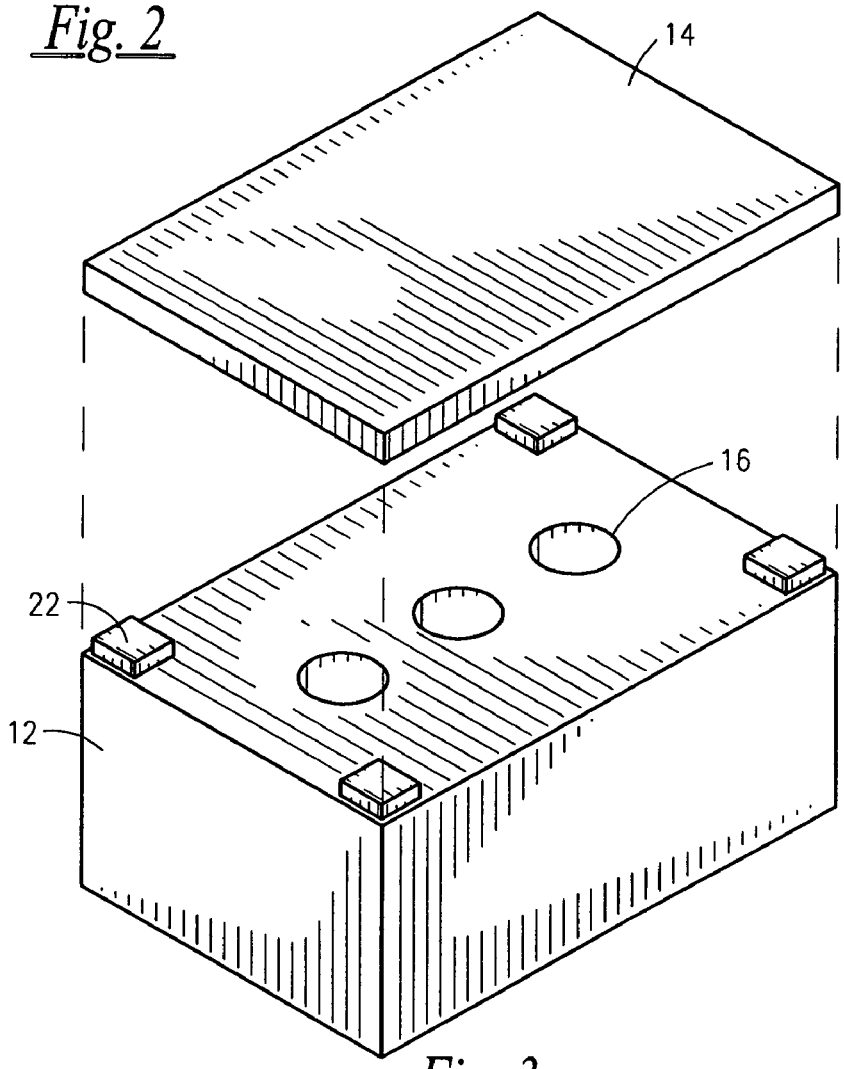
FIG. 3 is an exploded perspective view similar to FIG. 1, wherein the container further possesses a plurality of cushions for absorbing force and stabilizing the lid.
Figure 4:
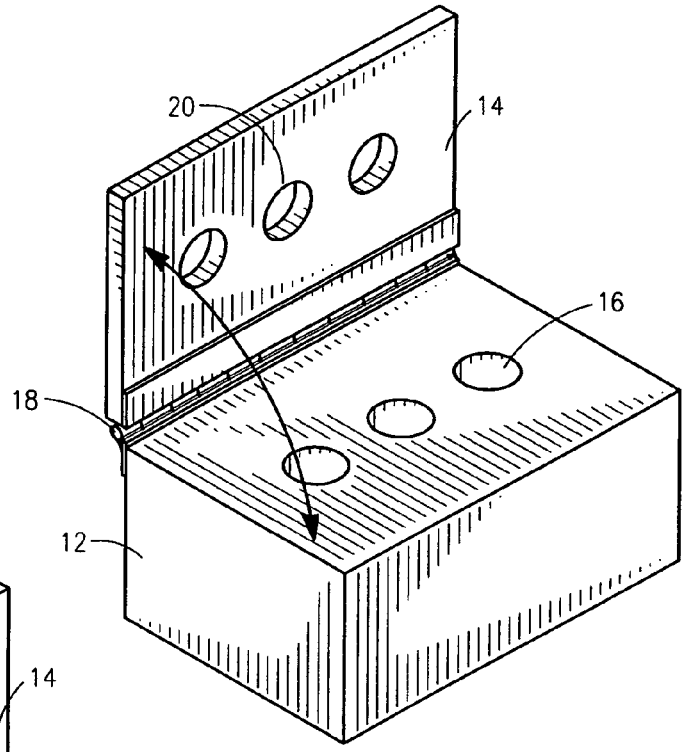
FIG. 4 is a perspective view of an alternate embodiment of the device having a lid coupled to the container about a hinge.
Figure 5:
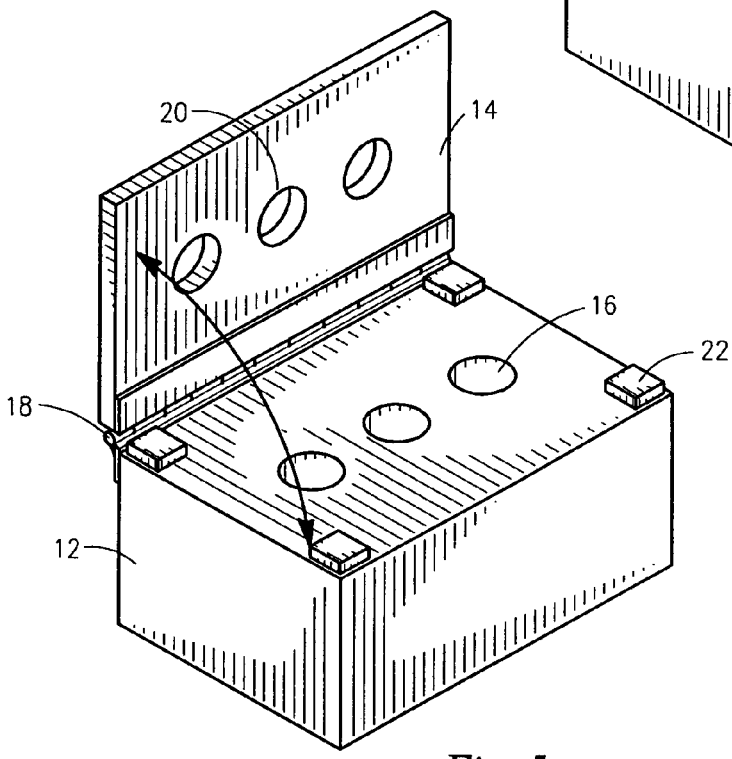
FIG. 5 is an alternate embodiment of FIG. 4 having a plurality of cushions.

The lid 14 may be free, unrestrained or unattached, as depicted in FIG. 1 through FIG. 3, or may be attached to the container 12 via a hinge 18, as depicted in FIG. 4 and FIG. 5. In either embodiment, the lid 14 has at least one cell or opening 20 corresponding to at least one recess 16 of the container. Likewise, a plurality of cells or openings 20 are provided to corresponded to a plurality of recesses 16. The cell(s) or opening(s) 20 are provided to accommodate the top portion of the ampule. The cell(s) or opening(s) 20 is/are envisioned as snugly fitting about the top of the ampule so as to create an impingement between the cell or opening 20 and the respective ampule top. Thus, when the lid 14 is selectively positioned adjacent the container 12, so that each cell or opening 20 snugly fits about an ampule retained by a recess 16, a force "F" may be delivered to the lid 14 for severing the top of the ampule in a manner that is safe to the user. After the top is severed, the lid 14 may be removed and the medicament in the ampule exposed for extraction therefrom.

In one exemplary embodiment, as illustrated in FIG. 3 and FIG. 5, a plurality of cushions 22 may be provided so as to absorb any excess force administered to the lid 14. The cushions 22 also provide stabilization to the lid 14 when selectively positioned adjacent the container and in contact with one or more ampules. In the embodiments illustrated by the figures, the cushions 22 are placed at respective corners of the container 12 top (upper surface) so that when the lid 14 is selectively brought into position, each cushion 22 acts to provide support, slight resistance, balance and stabilization to the lid 14 preceding the delivery of the force "F". The cushions 22 are envisioned as being fabricated from any number of materials, including rubber, plastic and/or foam, or a combination thereof, so long as the material is returnably resilient and durable for repeated usage as described above.

Figure 6:
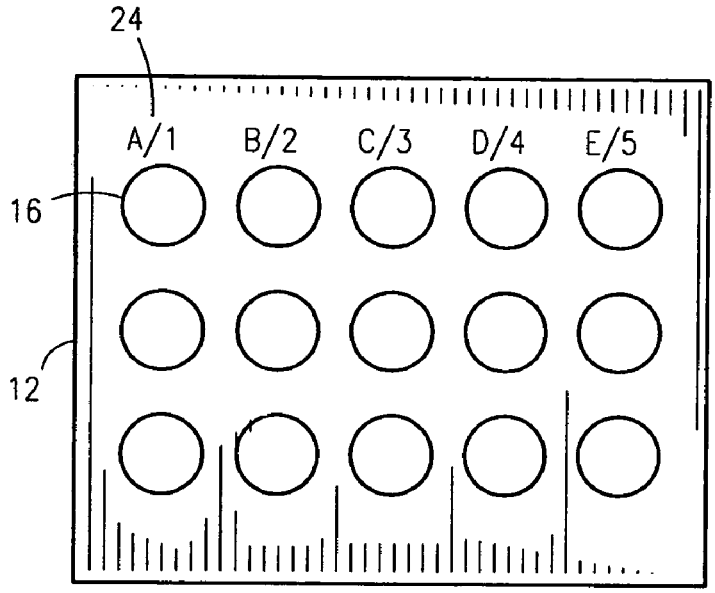
FIG. 6 is a top view of an alternate embodiment of the container having a plurality of recesses and corresponding indicia therewith.
Figure 7:
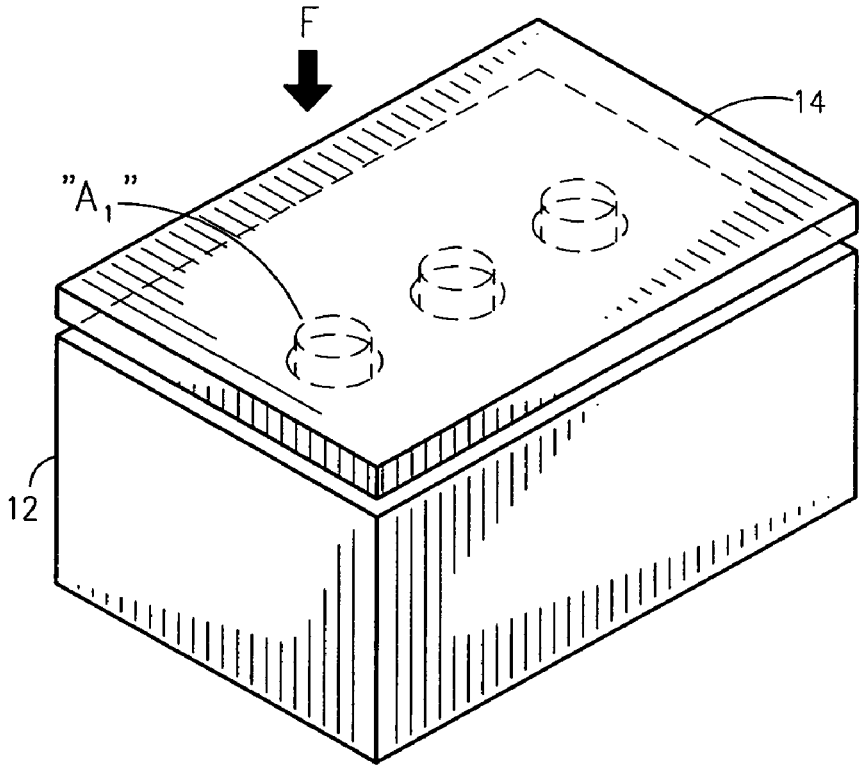
FIG. 7 is a perspective view of the lid selectively positioned adjacent the container and into contact with ampules retained by the recesses, the lid used for delivering a force and severing the top of the ampules.

In another exemplary embodiment depicted in FIG. 6, the container 12 may include indicia 24 for identifying and/or labeling each respective recess 16 provided in the container 12. The indicia 24 may include letters, numerals, a combination of letters and numerals, or other signifying indicia. The indicia 24 is particularly advantageous in a clinical environment, such as a hospital or physician's office. A health care provider may have multiple patients to administer medicine to, and the indicia 24 provides a convenient means for indexing or organizing the medicine with patient or room numbers, or other meaningful designations.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention, a user will place a medicinal ampule within a recess 16, or if multiple ampules are required, an ampule in each of the respective recesses 16 provided. The top of the ampule will extend above the surface of the container 12 and the recess 16 so that a lid 14 may be selectively positioned for severing the top from the ampule. The lid 14 is positioned so that a force "F" may be delivered to the lid 14 and transmitted in such a way as to crush or sever the top of the ampule and expose the medicaments contained therein. The lid 14 may then be removed from the container 12 and the ampule contents extracted and the exhausted ampule capsules discarded after use. In this manner, the ampule is safely crushed or severed, the contents preserved for proper use, and the ampule capsules and crushed top are safely disposable without the worry of abrasions, cuts or severe injury to the user.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A device for opening ampules comprising:

a container having at least one recess for retaining an ampule; and a lid selectively featuring at least one cell corresponding to said at least one recess, said at least one cell receiving a severable portion of said ampule;

wherein said lid is attached to said container via a hinge; and whereby engaging said ampule between the lid and the container severs said ampule.

2. The device of claim 1 further comprising a plurality of recesses for retaining a plurality of ampules.

3. The device of claim 1, wherein said lid has a plurality of cells corresponding to said plurality of recesses, said plurality of cells receiving a severable portion of one of said ampules.

4. The device of claim 3 further comprising indicia on said container for identifying each one of said plurality of recesses.

5. A device for opening ampules comprising:

a container having at least one recess for retaining an ampule;

a lid selectively featuring at least one cell corresponding to said at least one recess, said at least one cell receiving a severable portion of said ampule;

wherein said lid is attached to said container via a hinge; and a plurality of cushions placed along an upper surface of said lid, said plurality of cushions stabilizing said lid and absorbing any excess force generated by severing said ampule.

6. The device of claim 5 further comprising a plurality of recesses for retaining a plurality of ampules.

7. The device of claim 6, wherein said lid has a plurality of cells corresponding to said plurality of recesses, said plurality of cells receiving a severable portion of one of said ampules.

8. The device of claim 7 further comprising indicia on said container for identifying each one of said plurality of recesses.

* * * * *